US011128077B1

(12) United States Patent
Lai et al.

(10) Patent No.: US 11,128,077 B1
(45) Date of Patent: Sep. 21, 2021

(54) ELECTRICAL CONNECTOR

(71) Applicants: Austin Lai, Taichung (TW); Chi-I Lai, Taichung (TW); Chao-I Chien, Taichung (TW); Chung-Jen Chang, Taichung (TW)

(72) Inventors: Austin Lai, Taichung (TW); Chi-I Lai, Taichung (TW); Chao-I Chien, Taichung (TW); Chung-Jen Chang, Taichung (TW)

(73) Assignee: AVERTRONICS INC., Taichung (TW)

( * ) Notice: Subject to any disclaimer, the term of this patent is extended or adjusted under 35 U.S.C. 154(b) by 0 days.

(21) Appl. No.: 16/990,862

(22) Filed: Aug. 11, 2020

(30) Foreign Application Priority Data

Jun. 30, 2020 (TW) ..... 109122089

(51) Int. Cl.

| | |
|---|---|
| ***H01R 13/428*** | (2006.01) |
| ***H01R 13/11*** | (2006.01) |
| ***H01R 13/629*** | (2006.01) |
| ***H01R 13/05*** | (2006.01) |
| ***H01R 24/68*** | (2011.01) |
| ***H01R 13/627*** | (2006.01) |
| ***H01R 24/76*** | (2011.01) |
| ***H01R 13/08*** | (2006.01) |

(52) U.S. Cl.
CPC ..... *H01R 13/111* (2013.01); *H01R 13/052* (2013.01); *H01R 13/08* (2013.01); *H01R 13/629* (2013.01); *H01R 13/6277* (2013.01); *H01R 24/68* (2013.01); *H01R 24/76* (2013.01)

(58) Field of Classification Search
CPC ..... H01R 13/426; H01R 2103/00; H01R 13/5205; H01R 13/4223; H01R 2101/00
USPC ..... 439/744, 598, 599, 589, 595, 871
See application file for complete search history.

(56) References Cited

U.S. PATENT DOCUMENTS

| | | | | |
|---|---|---|---|---|
| 4,429,938 | A * | 2/1984 | Flor | H01R 13/625 403/349 |
| 4,508,407 | A * | 4/1985 | Ball | H01R 13/622 439/312 |
| 5,637,010 | A * | 6/1997 | Jost | H01R 13/6277 439/352 |
| 6,824,415 | B2 * | 11/2004 | Wlos | H01R 13/6276 439/348 |
| 10,490,937 | B1 * | 11/2019 | Su | H01R 13/6275 |

(Continued)

*Primary Examiner* — Phuong Chi Thi Nguyen
(74) *Attorney, Agent, or Firm* — Che-Yang Chen; Law Office of Michael Chen

(57) ABSTRACT

An electrical connector may include a first connecting member and a second connecting member adapted to be connected together. The first connecting member comprises a socket having a connecting surface, and the connecting surface comprises two first receiving slots and a second receiving slot. An outer surface of the socket has at least a guiding groove, and each of the first receiving slot and the second receiving slot comprises at least a conductive terminal installed therein. The socket is surrounded by an outer ring portion, and a peripheral groove is formed between the socket and the outer ring portion. The second connecting member has a base and an inner ring portion, and the base has two first blades and a second blade which are surrounded by the inner ring portion, and an inner periphery of the inner ring portion has at least a guiding piece.

10 Claims, 11 Drawing Sheets

(56) References Cited

U.S. PATENT DOCUMENTS

2014/0017928 A1* 1/2014 Shah ..... H01R 13/6277
439/350

* cited by examiner

ELECTRICAL CONNECTOR

FIELD OF THE INVENTION

The present invention relates to a connector and more particularly to an electrical connector having two connecting members, and one can be connected to the other in diagonal direction.

BACKGROUND OF THE INVENTION

Referring to FIG. 11, a conventional cylindrical electrical connector comprises a female connector (30) and a male connector (40). The female connector (30) has a column (31) axially extended therefrom, and a socket (32) is formed inside the column (31). Also, a peripheral groove (33) is formed between an inner periphery of the column (31) and an outer periphery of the socket (32). The socket (32) comprises a connecting surface (321), and a plurality of power ports (322) and a plurality of signal ports (323) are formed on the connecting surface (321). The male connector (40) adapted to connect to the female connector (30) has a plug body (41), and the plug body (41) comprises a peripheral portion (42) which is configured to insert into the peripheral groove (33). The plug body (41) has a plurality of protruded power terminals (43) and a plurality of protruded signal terminals (44) which are surrounded by the peripheral portion (42). The power terminals (43) are inserted into the power ports (322) while the signal terminals (44) are inserted into the signal ports (323), so as to complete the electrical connection.

However, the conventional electrical connector has following disadvantages: (i) the male connector (40) and the female connector (30) can only be connected straightly, and the connecting surface (321) is prone to be worn by the power terminals (43) and the signal terminals (44) when the male connector (40) and the female connector (30) are not aligned; (ii) the resistance is generated when the power terminals (43) and the signal terminals (44) are respectively connected to the power ports (322) and the signal ports (323) and when the air in the peripheral groove (33) cannot be discharged, and, on the other hand, the vacuum suction is generated when the power terminals (43) and the signal terminals (44) are respectively disconnected to the power ports (322) and the signal ports (323); (iii) in order to prevent damage to the electronic components due to sparks, when wiring, the positive terminal and the negative terminal of the power terminal (43) cannot be inserted into the female connector (30) simultaneously. Therefore, there remains a need for a new and improved design for an electrical connector to overcome the problems presented above.

SUMMARY OF THE INVENTION

The present invention provides an electrical connector comprising a first connecting member and a second connecting member, and the first connecting member is defined by an x-y-z axis system, which are perpendicular to each other. The first connecting member comprises a cylindrical socket extended along the z-axis, and a connecting surface is formed at an end of the socket perpendicular to the z-axis. The connecting surface has two rectangular first receiving slots and a rectangular second receiving slot thereon. Each of the two first receiving slots has two long edges which are parallel to the y-axis, and the second receiving slot comprises two long edges which are parallel to the x-axis. An outer surface of the socket comprises at least a guiding groove extended along the z-axis. Each of the two first receiving slots has two short edges, and one of the two short edges of the first receiving slot is located adjacent to the guiding groove while the other of the two short edges thereof is located adjacent to one of the two long edges of the second receiving slot. Each of the first receiving slot and the second receiving slot comprises at least a conductive terminal installed therein. The socket is surrounded by an outer ring portion, and a peripheral groove is formed between the socket and the outer ring portion. The second connecting member has a base and an inner ring portion which are formed integrally, and the base has two first blades and a second blade which are formed in board body and respectively protrude from the base at positions corresponding to the first receiving slots and the second receiving slot. The first blades and the second blade are surrounded by the inner ring portion, and an inner periphery of the inner ring portion has at least a protruded guiding piece adjacent to the two first blades, and an O-ring is disposed on an outer periphery of the inner ring portion.

In one embodiment, two short edges of the second receiving slot are located at two lateral sides of the second receiving slot, and a plurality of signal channels are formed on the socket at two lateral sides of the first receiving slots and the second receiving slot, and the base comprises a plurality of protruded signal pins located at positions corresponding to the signal channels; the length of the signal pin protruding from the base is one half of the length of the second blade; the signal pins are inserted into the signal channels after the second blade is coupled with the conductive terminal.

In another embodiment, the conductive terminal comprises a positioning piece, an elastic piece, and a first pin, and the positioning piece is adapted to be inserted and secured in the first receiving slot or the second receiving slot; an end of the positioning piece adjacent to the connecting surface has a folded portion, and an end of the elastic piece is connected to the folded portion while the other end thereof is suspended and located in the first receiving slot or the second receiving slot; the first pin is configured to protrude from an end of the positioning piece other than the folded portion.

In still another embodiment, each of the first receiving slot and the second receiving slot comprises two conductive terminals inserted therein, and the first blade or the second blade is coupled and held between the two elastic pieces of the two conductive terminals.

In a further embodiment, a surface of the socket other than the connecting surface comprises a recess thereon, and the recess is communicated with the first receiving slots and the second receiving slot; a cover board is coupled in the recess, and the first pin of the conductive terminal penetrates through and protrudes from the cover board.

In still a further embodiment, the first connecting member comprises an accommodating periphery located at an end of the first connecting member other than the outer ring portion, and the first pin of the conductive terminal is surrounded by the accommodating periphery, and a hot melt adhesive (HMA) layer filled in the accommodating periphery is configured to form a seal between the first pin and the cover board.

In yet a further embodiment, the outer ring portion of the first connecting member has a plurality of drains which are communicated with a bottom portion of the peripheral groove, and a plurality of drainage channels penetrate through the base of the second connecting member, and the drains and the drainage channels are adapted to achieve drainage function.

In a preferred embodiment, at least a first vent penetrates through the inner ring portion; when the first connecting member and the second connecting member are connected, the drains, the drainage channels, and the first vent are communicated to achieve heat discharging function.

In an advantageous embodiment, a surface of the base having the protruded first blades and the protruded second blade comprises a vent groove thereon, and the vent groove is communicated with the drainage channels, the drains, and the first vent, the first receiving slots, and the second receiving slot, so that the heat discharging function is extended to the first receiving slots and the second receiving slot.

In a particular embodiment, an end of the inner ring portion away from the base comprises an oblique opening, and with the oblique opening, the height of the inner ring portion adjacent to the guiding piece is lower than that of the inner ring portion adjacent to the second blade, and the oblique opening is adapted to guide the second connecting member to be diagonally inserted into the first connecting member.

Comparing with conventional electrical connector, the present invention is advantageous because: (i) when the second connecting member is detached diagonally from the first connecting member, the resistance between the first connecting member and the second connecting member is significantly reduced than detached in straight direction so as to improve the convenience of connection and disconnection; (ii) the first connecting member and the second connecting member are connected easily and the situation that the first blades and the second blade scratch the connecting surface due to the diagonal connection is prevented; (iii) the signal pins are inserted into the signal channels after the second blade is coupled with the conductive terminal, and, meanwhile, the second connecting member is about to fully aligned with the first connecting member such that the connection between the signal pins and the signal channels is not affected by the diagonal insertion of the second connecting member; and (iv) when the first connecting member and the second connecting member are connected and the electrical connector is in use, the heat and water can be discharged from the drains, the drainage channels, and the first vent.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
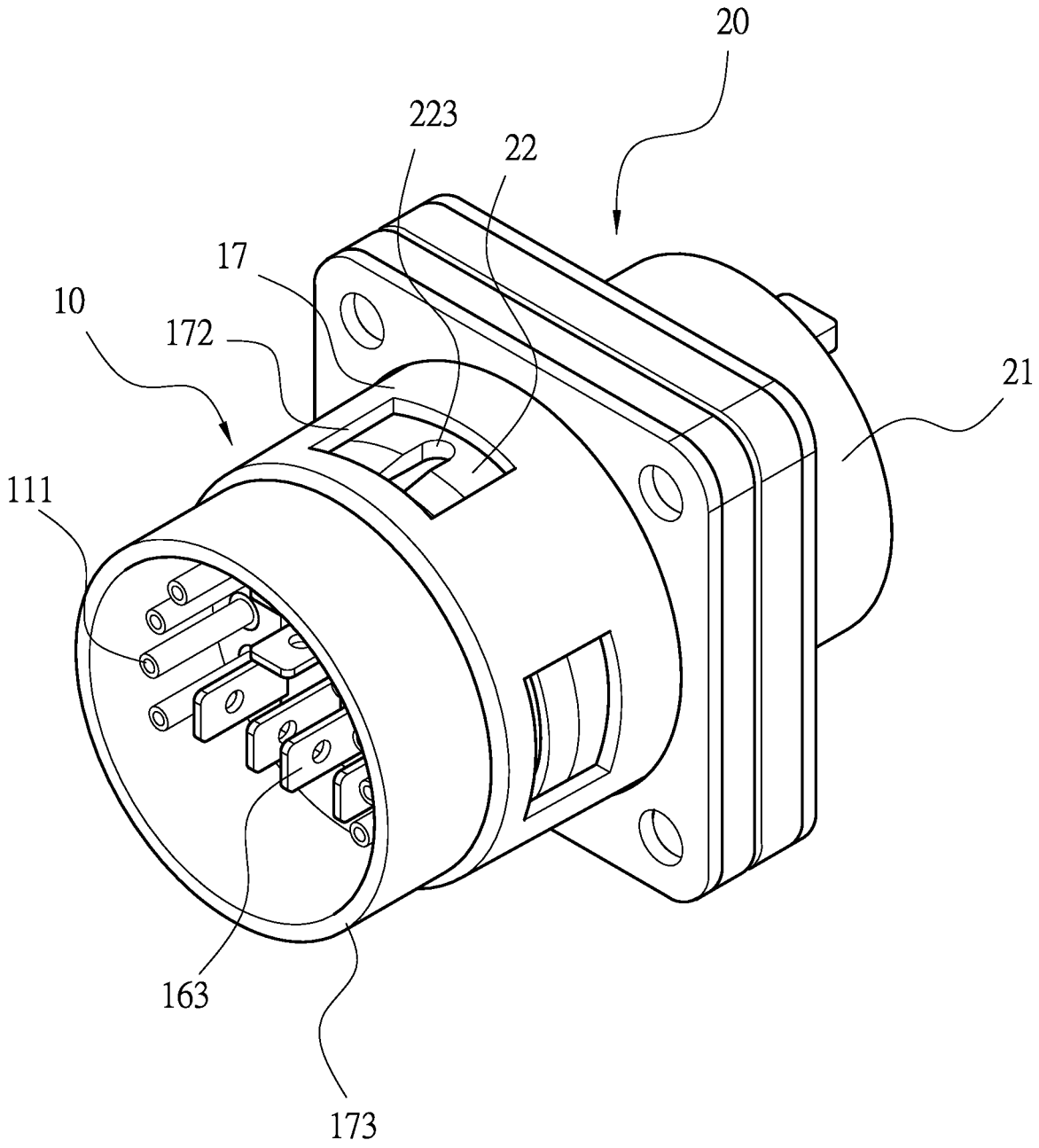
FIG. 1 is a three-dimensional assembly view of an electrical connector of the present invention.
Figure 2:
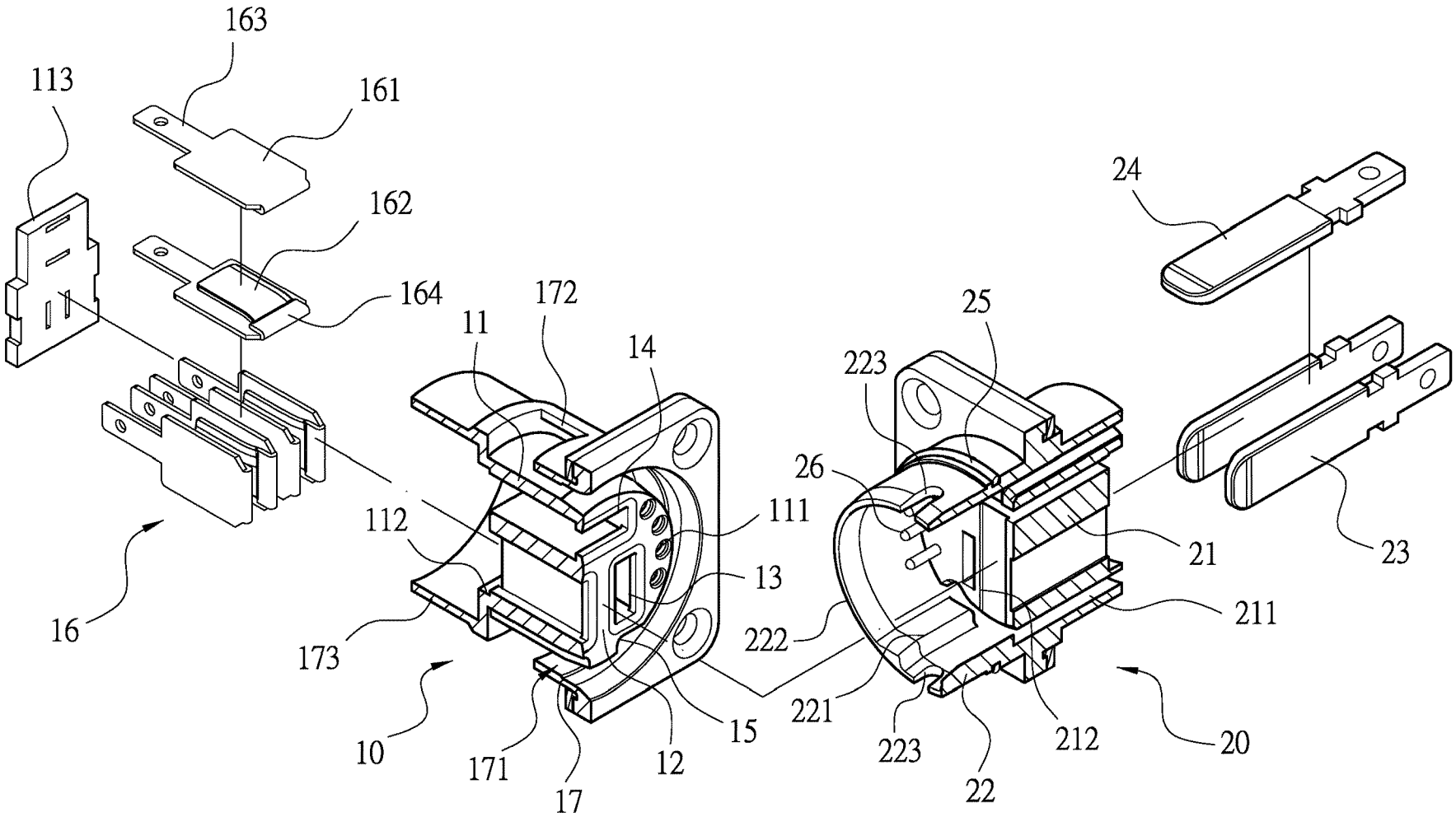
FIG. 2 is a three-dimensional exploded view of the electrical connector of the present invention.
Figure 3:
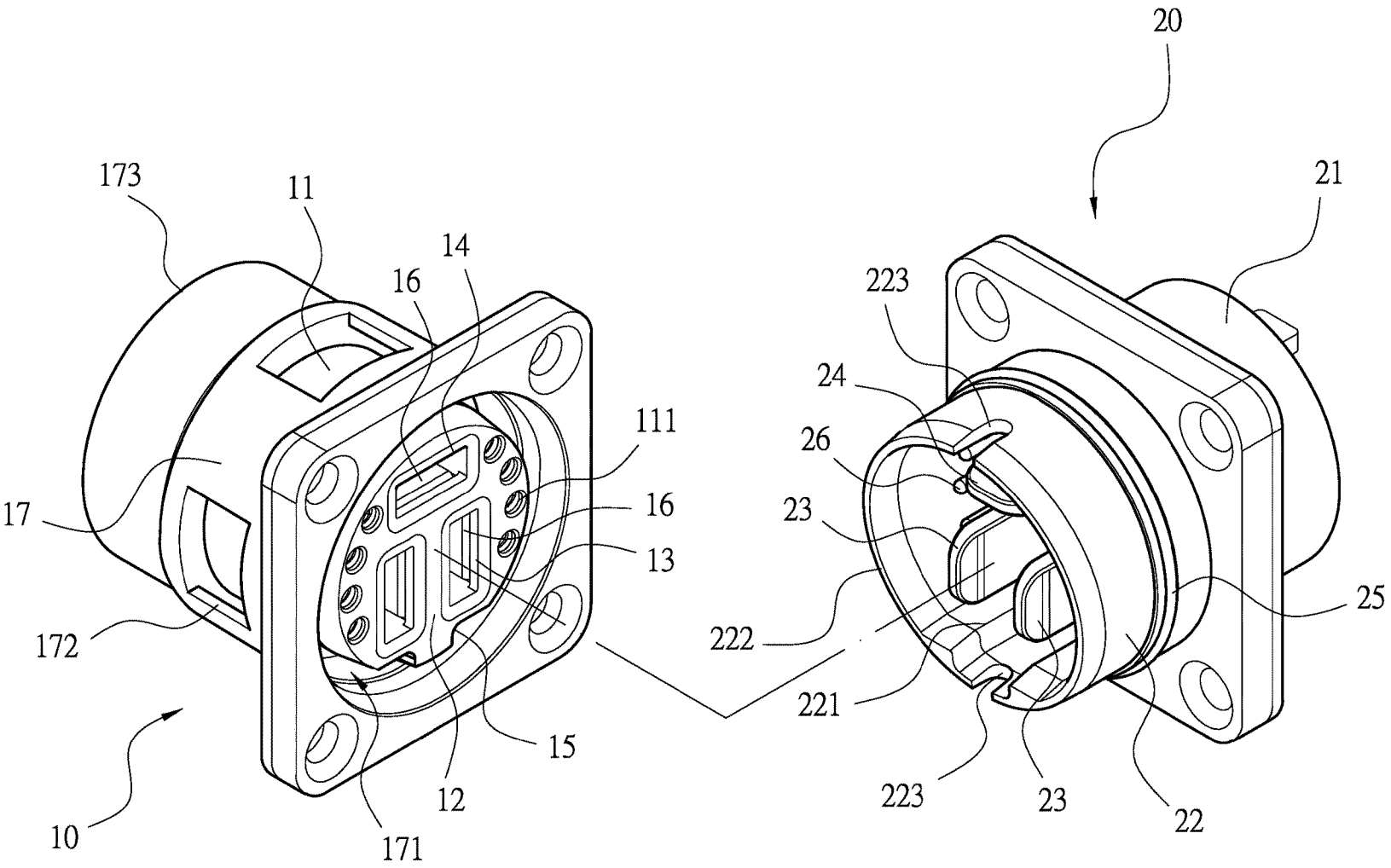
FIG. 3 is a three-dimensional schematic view illustrating a first connecting member and a second connecting member are configured to be connected in the present invention.
Figure 4:
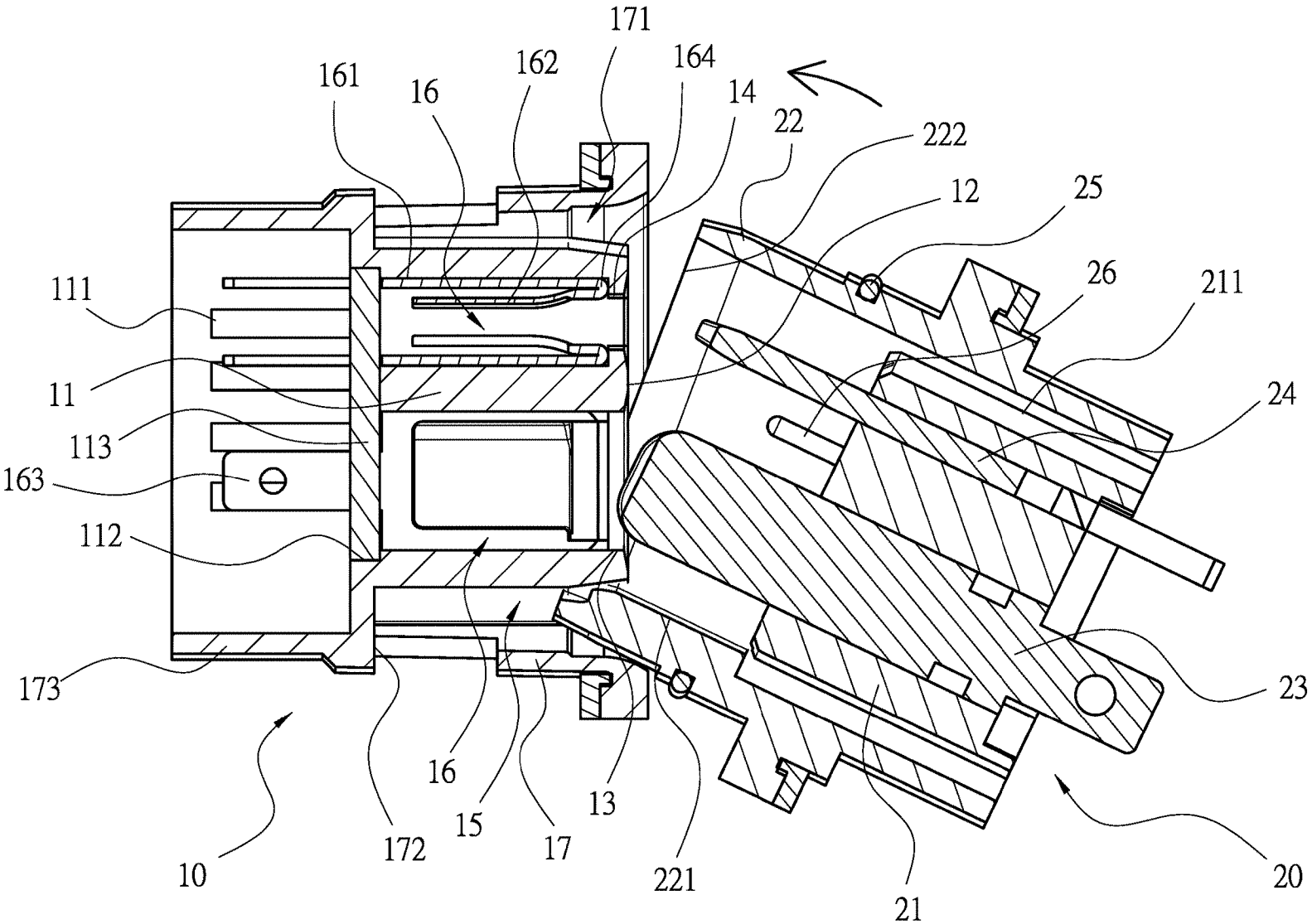
FIG. 4 is a first schematic view illustrating the second connecting member is connected to the first connecting member in diagonal direction in the present invention.
Figure 5:
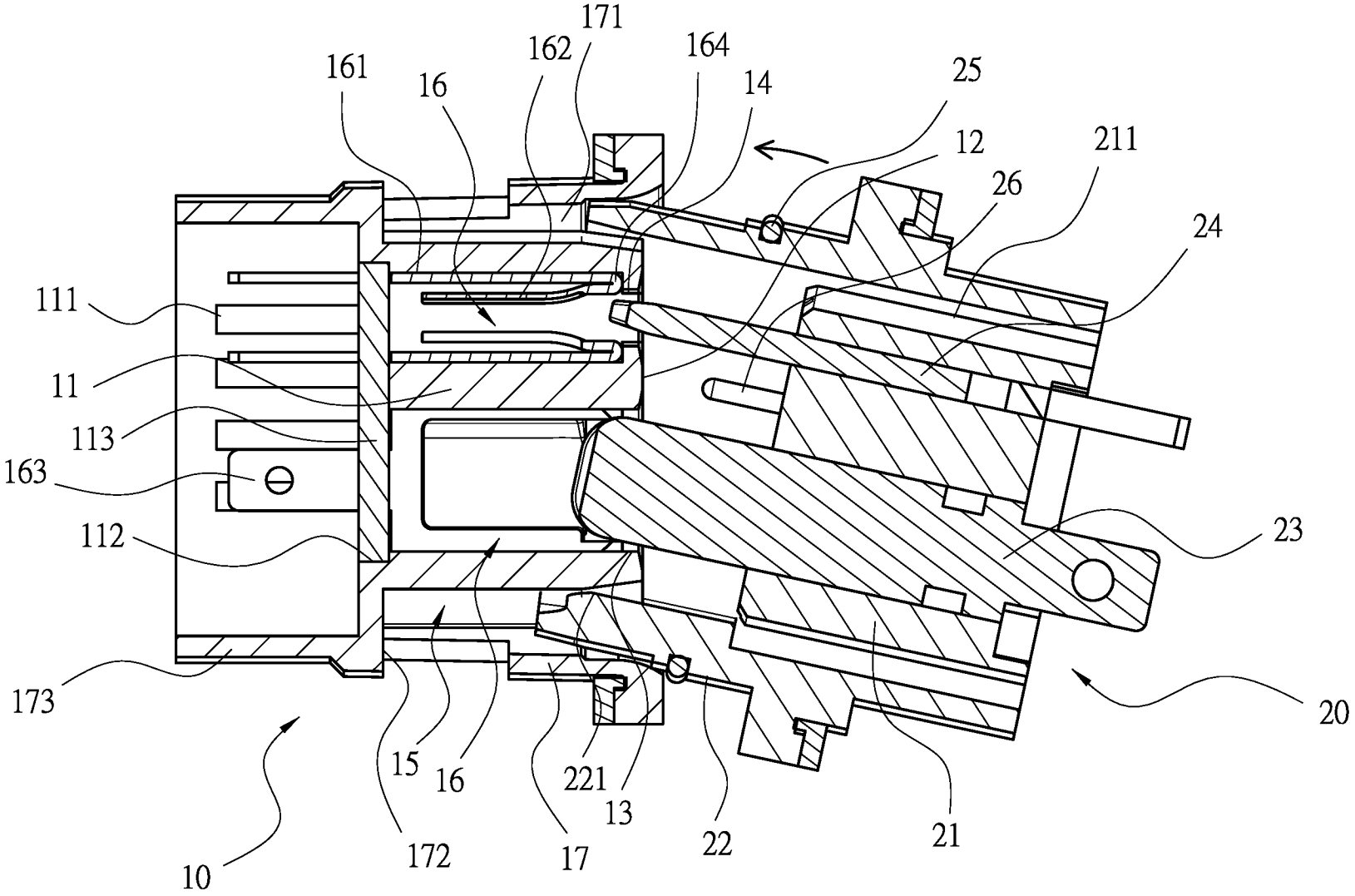
FIG. 5 is a second schematic view illustrating the second connecting member is connected to the first connecting member in diagonal direction in the present invention.
Figure 6:
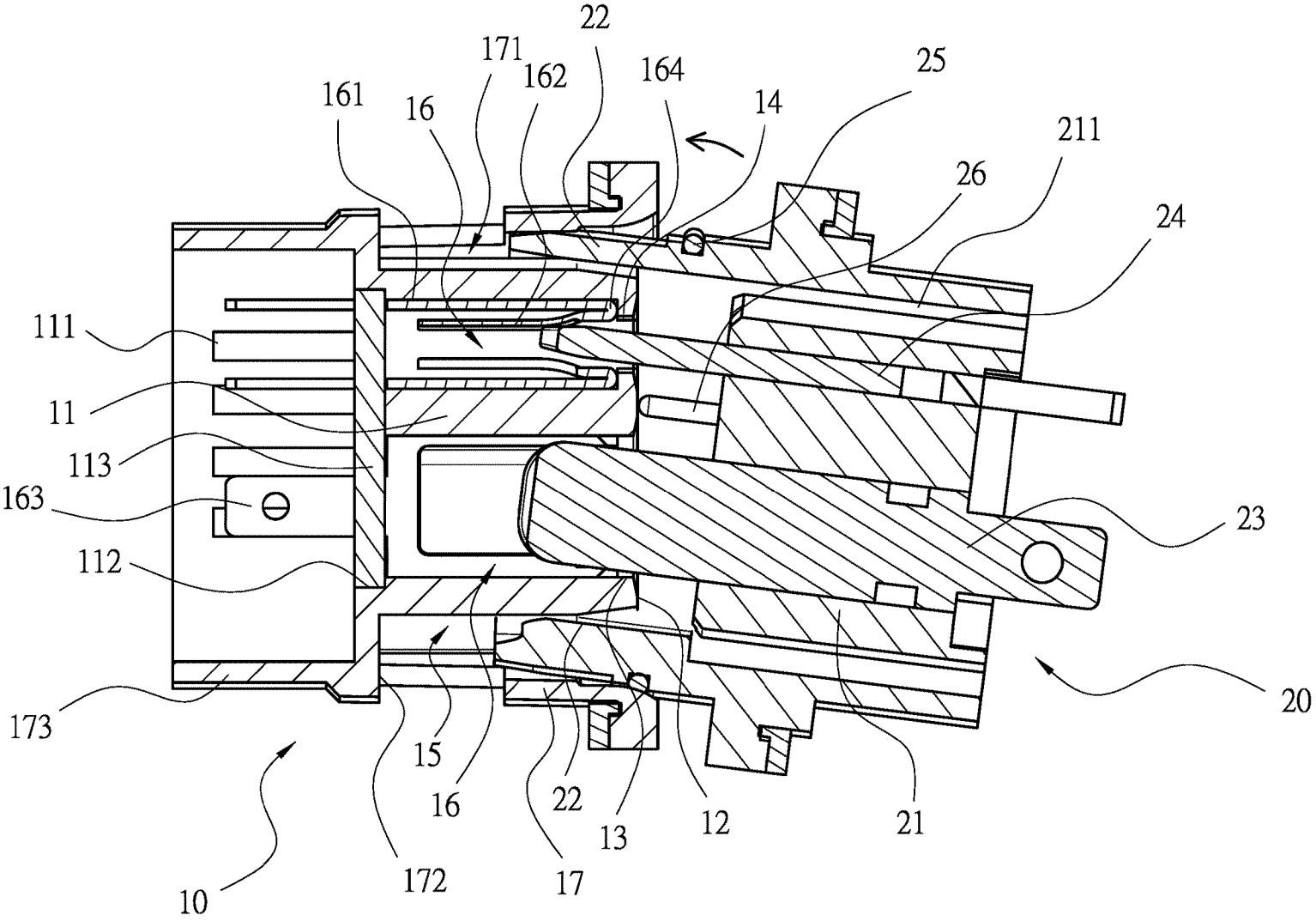
FIG. 6 is a third schematic view illustrating the second connecting member is connected to the first connecting member in diagonal direction in the present invention.
Figure 7:
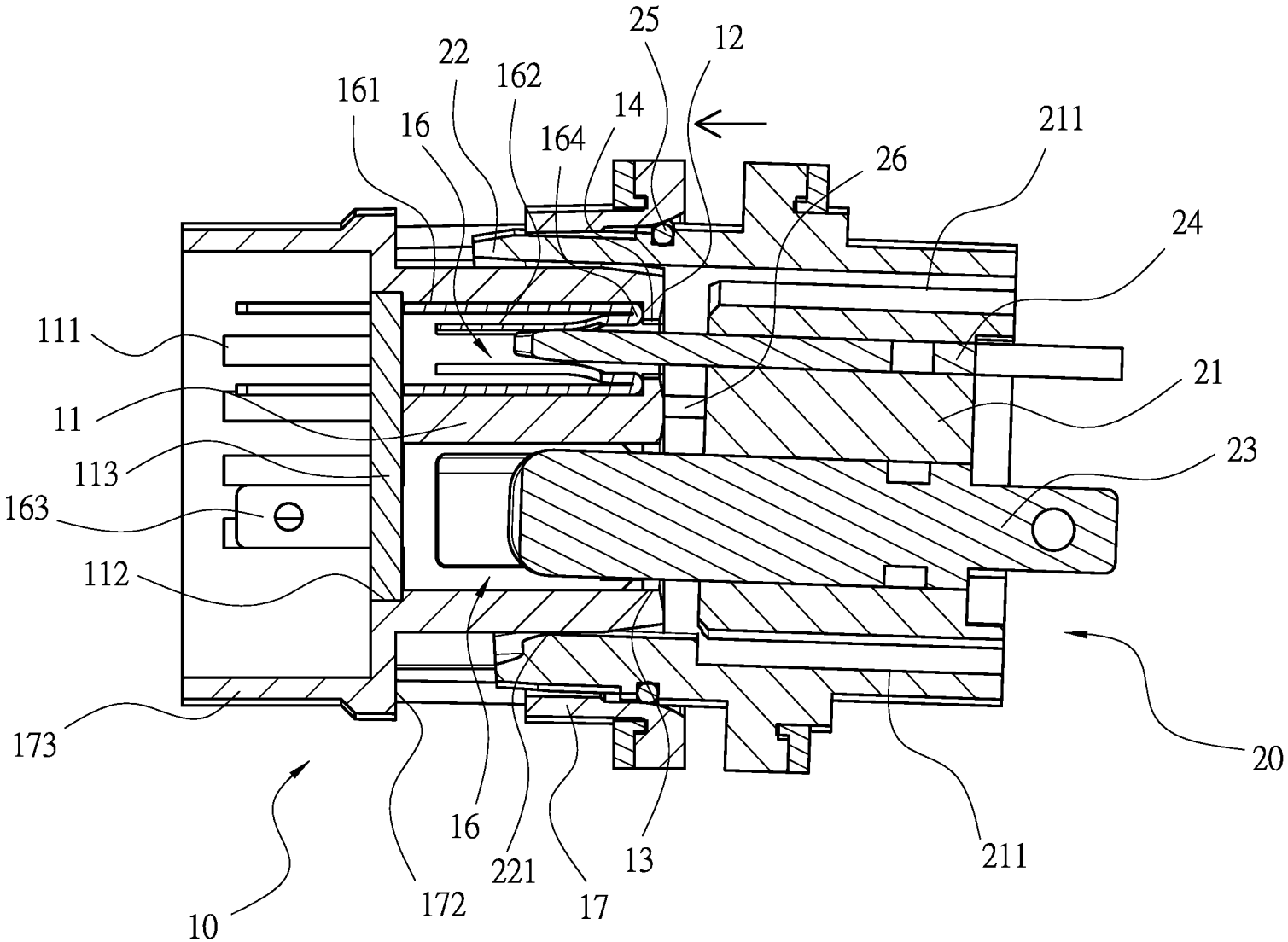
FIG. 7 is a fourth schematic view illustrating the second connecting member is connected to the first connecting member in diagonal direction in the present invention.

In order to further understand the goal, characteristics and effect of the present invention, a number of embodiments along with the drawings are illustrated as following:

Referring to FIGS. 1 to 3, the present invention provides an electrical connector comprising a first connecting member (10) and a second connecting member (20), and the first connecting member (10) is defined by an x-y-z axis system, which are perpendicular to each other. The first connecting member (10) comprises a cylindrical socket (11) extended along the z-axis, and a connecting surface (12) is formed at an end of the socket (11) perpendicular to the z-axis. Moreover, the connecting surface (12) has two rectangular first receiving slots (13) and a rectangular second receiving slot (14) thereon. Each of the two first receiving slots (13) has two long edges which are parallel to the y-axis, and the second receiving slot (14) comprises two long edges which are parallel to the x-axis. Also, an outer surface of the socket (11) comprises at least a guiding groove (15) extended along the z-axis. Each of the two first receiving slots (13) has two short edges, and one of the two short edges of the first receiving slot (13) is located adjacent to the guiding groove (15) while the other of the two short edges thereof is located adjacent to one of the two long edges of the second receiving slot (14). Furthermore, each of the first receiving slot (13)

and the second receiving slot (14) comprises at least a conductive terminal (16) installed therein. The socket (11) is surrounded by an outer ring portion (17), and a peripheral groove (171) is formed between the socket (11) and the outer ring portion (17). Two short edges of the second receiving slot (14) are located at two lateral sides of the second receiving slot (14), and a plurality of signal channels (111) are formed on the socket (11) at two lateral sides of the first receiving slots (13) and the second receiving slot (14). The conductive terminal (16) comprises a positioning piece (161), an elastic piece (162), and a first pin (163), and the positioning piece (161) is adapted to be inserted and secured in the first receiving slot (13) or the second receiving slot (14). Also, an end of the positioning piece (161) adjacent to the connecting surface (12) has a folded portion (164), and an end of the elastic piece (162) is connected to the folded portion (164) while the other end thereof is suspended and located in the first receiving slot (13) or the second receiving slot (14). The first pin (163) is configured to protrude from an end of the positioning piece (161) other than the folded portion (164). A surface of the socket (11) other than the connecting surface (12) comprises a recess (112) thereon, and the recess (112) is communicated with the first receiving slots (13) and the second receiving slot (14). Furthermore, a cover board (113) is coupled in the recess (112), and the first pin (163) of the conductive terminal (16) penetrates through and protrudes from the cover board (113). The second connecting member (20) has a base (21) and an inner ring portion (22) which are formed integrally, and the base (21) has two first blades (23) and a second blade (24) which are formed in board body and respectively protrude from the base (21) at positions corresponding to the first receiving slots (13) and the second receiving slot (14). The first blades (23) and the second blade (24) are surrounded by the inner ring portion (22), and an inner periphery of the inner ring portion (22) has at least a protruded guiding piece (221) adjacent to the two first blades (23), and an O-ring (25) is disposed on an outer periphery of the inner ring portion (22).

Figure 8:
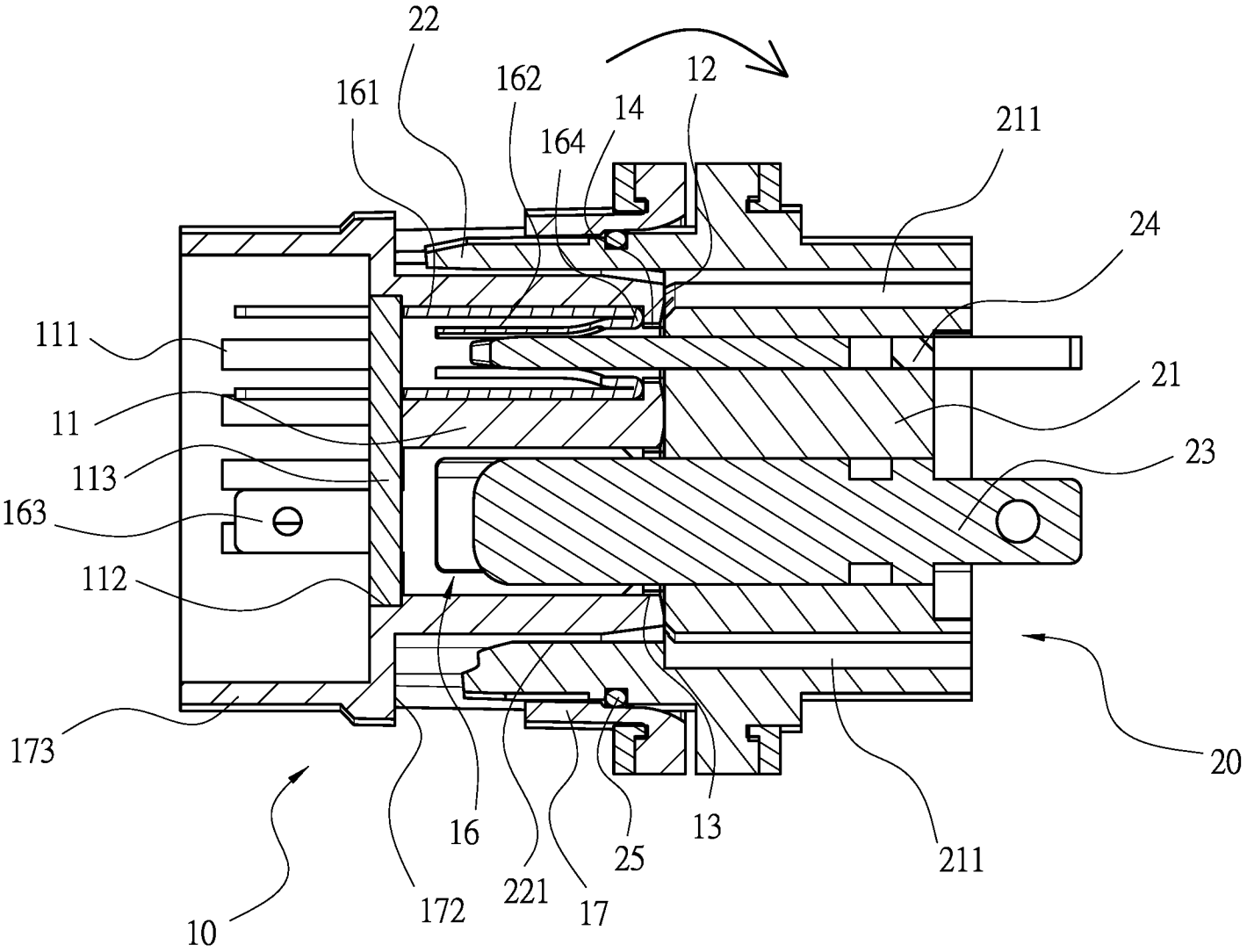
FIG. 8 is a schematic view illustrating the second connecting member is detached from the first connecting member in diagonal direction in the present invention.

In actual application, referring to FIGS. 2 and 4 to 7, with the guiding groove (15) of the first connecting member (10) and the guiding piece (221) of the second connecting member (20), the inner ring portion (22) of the second connecting member (20) is adapted to be diagonally inserted into the peripheral groove (171). When the second connecting member (20) is connected to the first connecting member in diagonal direction, the guiding piece (221) is configured to be coupled with the guiding groove (15), so that the first blades (23) and the second blade (24) are adapted to align with and directly insert into the first receiving slots (13) and the second receiving slot (14) respectively. Also, when the guiding piece (221) is slid along the guiding groove (15), the inner ring portion (22) is coupled with the outer ring portion (17) to align the inserted direction of the second connecting member (20) and to enable the two first blades (23) to be aligned and inserted into the two first receiving slots (13). Moreover, after inserted into the first receiving slots (13), the first blades (23) are adapted to make contact with the conductive terminal (16) and positioned, and the first blades (23) are abutted against the conductive terminal (16) so as to limit the inserted position and angle of the second blade (24), thereby preventing the second blade (24) from scratching the connecting surface (12) of the first connecting member (10). The second blade (24) is adapted to be aligned and inserted into the second receiving slot (14) and to be abutted against the conductive terminal (16) such that the first connecting member (10) and the second connecting member (20) are configured to be connected easily and the situation that the first blades (23) and the second blade (24) scratch the connecting surface (12) due to the diagonal connection is prevented. In addition, the base (21) comprises a plurality of protruded signal pins (26) located at positions corresponding to the signal channels (111). The length of the signal pin (26) protruding from the base (21) is one half of the length of the second blade (24). After the second blade (24) is coupled with the conductive terminal (16), the signal pins (26) are inserted into the signal channels (111), and, meanwhile, the second connecting member (20) is about to fully aligned with the first connecting member (10) such that the connection between the signal pins (26) and the signal channels (111) is not affected by the diagonal insertion of the second connecting member (20). Thereafter, the O-ring (25) is abutted against the outer ring portion (17) so as to complete the connection between the first connecting member (10) and the second connecting member (20). The O-ring (25) is diagonally inserted into the peripheral groove (171), so that the resistance between the O-ring (25) and the outer ring portion (17) generated during the insertion process is reduced. The cooperation among the outer ring portion (17), the inner ring portion (22), and the O-ring (25) is configured to achieve the waterproof effect. Referring to FIG. 8, when the second connecting member (20) is detached from the first connecting member (10), the second connecting member (20) is adapted to be diagonally pulled out, and the O-ring (25), the signal pins (26), the second blade (24), and the first blades (23) are detached sequentially from the first connecting member (10). When the second connecting member (20) is diagonally detached from the first connecting member (10), the resistance between the first connecting member (10) and the second connecting member (20) is significantly reduced than detached in straight direction so as to improve the convenience of connection and disconnection. Also, an end of the inner ring portion (22) away from the base (21) comprises an oblique opening (222), and with the oblique opening (222), the height of the inner ring portion (22) adjacent to the guiding piece (221) is lower than that of the inner ring portion (22) adjacent to the second blade (24). Moreover, with the oblique opening (222), the user can determine the insertion connection before the first connecting member (10) and the second connecting member (20) are connected, and the oblique opening (222) is adapted to guide the second connecting member (20) to be diagonally inserted into the first connecting member (10). Also, when the second connecting member (20) is connected to the first connecting member (10) in diagonal direction, the first blades (23) are configured to couple with the conductive terminals (16) in the first receiving slots (13), and, thereafter, the second blade (24) is coupled to the conductive terminal (16) in the second receiving slot (14). In practice, the negative of power supply is electrically connected to the first blades (23) while the positive thereof is electrically connected to the second blade (24), and the first blades (23) and the second blade (24) are electrically conducted in sequence, that can prevent sparks due to the positive and the negative conducting in the same time.

Referring to FIGS. 2 and 3, each of the two first receiving slots (13) has two conductive terminals (16) inserted therein while the second receiving slot (14) comprises two conductive terminals (16) inserted therein, and the first blade (23) or the second blade (24) is coupled between the two elastic pieces (162) of the two conductive terminals (16). The two conductive terminals (16) are formed to fit different sizes of the first receiving slot (13) and different thicknesses of the first blade (23), and to enhance practicality and reduce costs, the first receiving slot (13) is adapted to have only one conductive terminal (16). When the two conductive terminals (16) are installed in the first receiving slot (13), the two first pins (163) are spaced and parallel, and the wire is positioned and welded between the first pins (163), which makes welding process easier and increases the conductive area.

Figure 9:
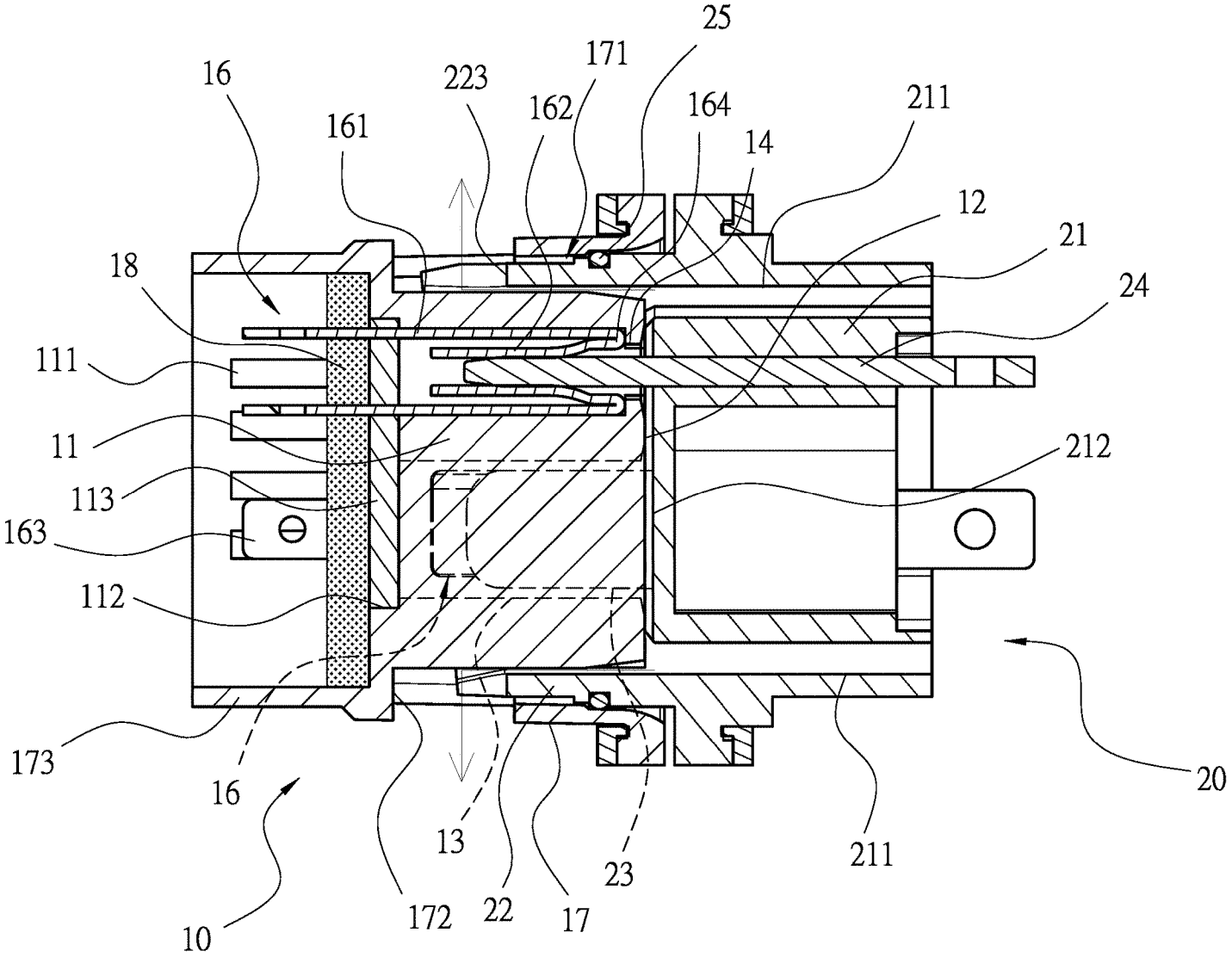
FIG. 9 is a sectional view illustrating the electrical connector achieves heat discharging function in the present invention.
Figure 10:
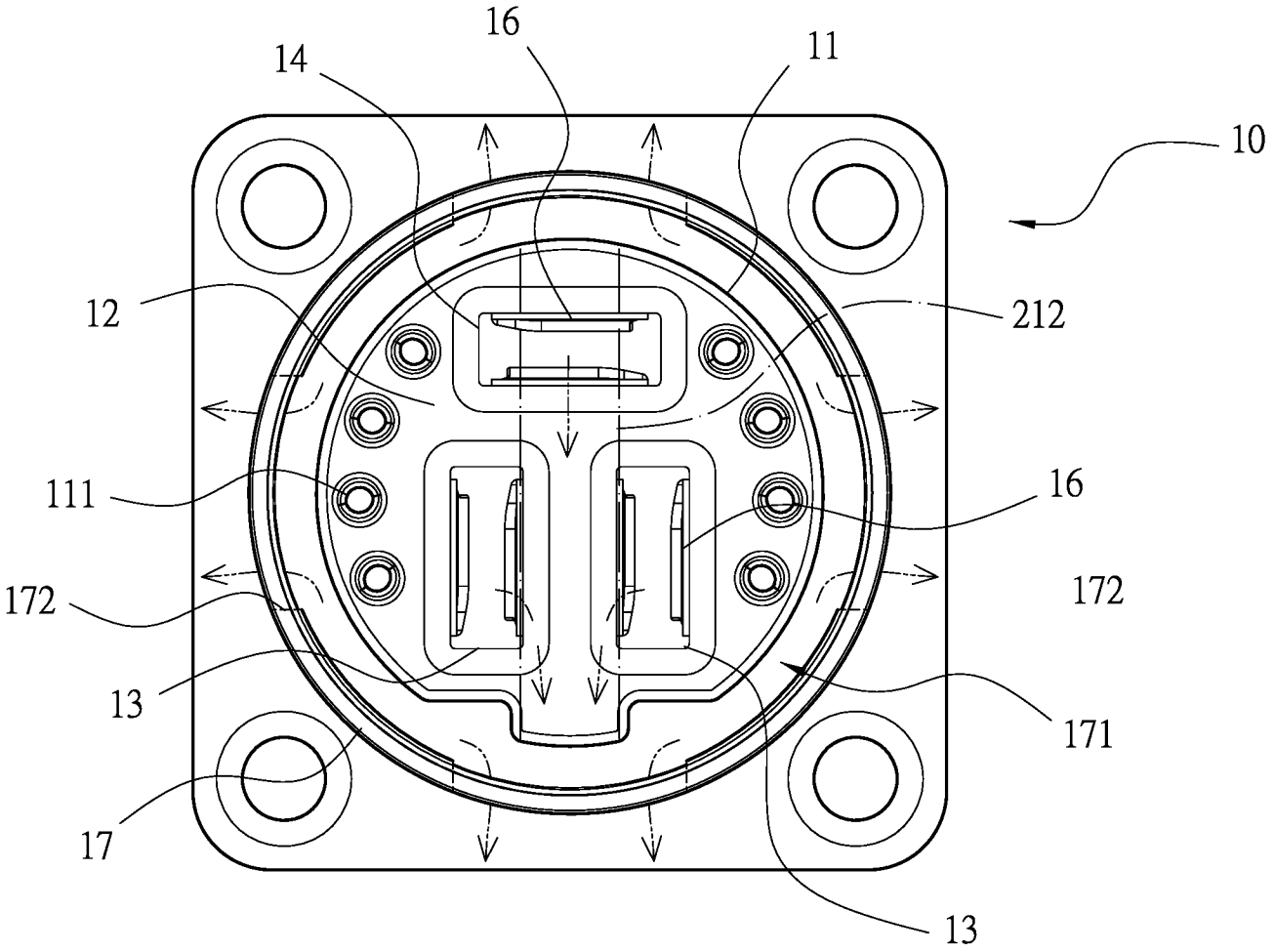
FIG. 10 is a schematic view illustrating the electrical connector achieves heat discharging function in the present invention.
Figure 11:
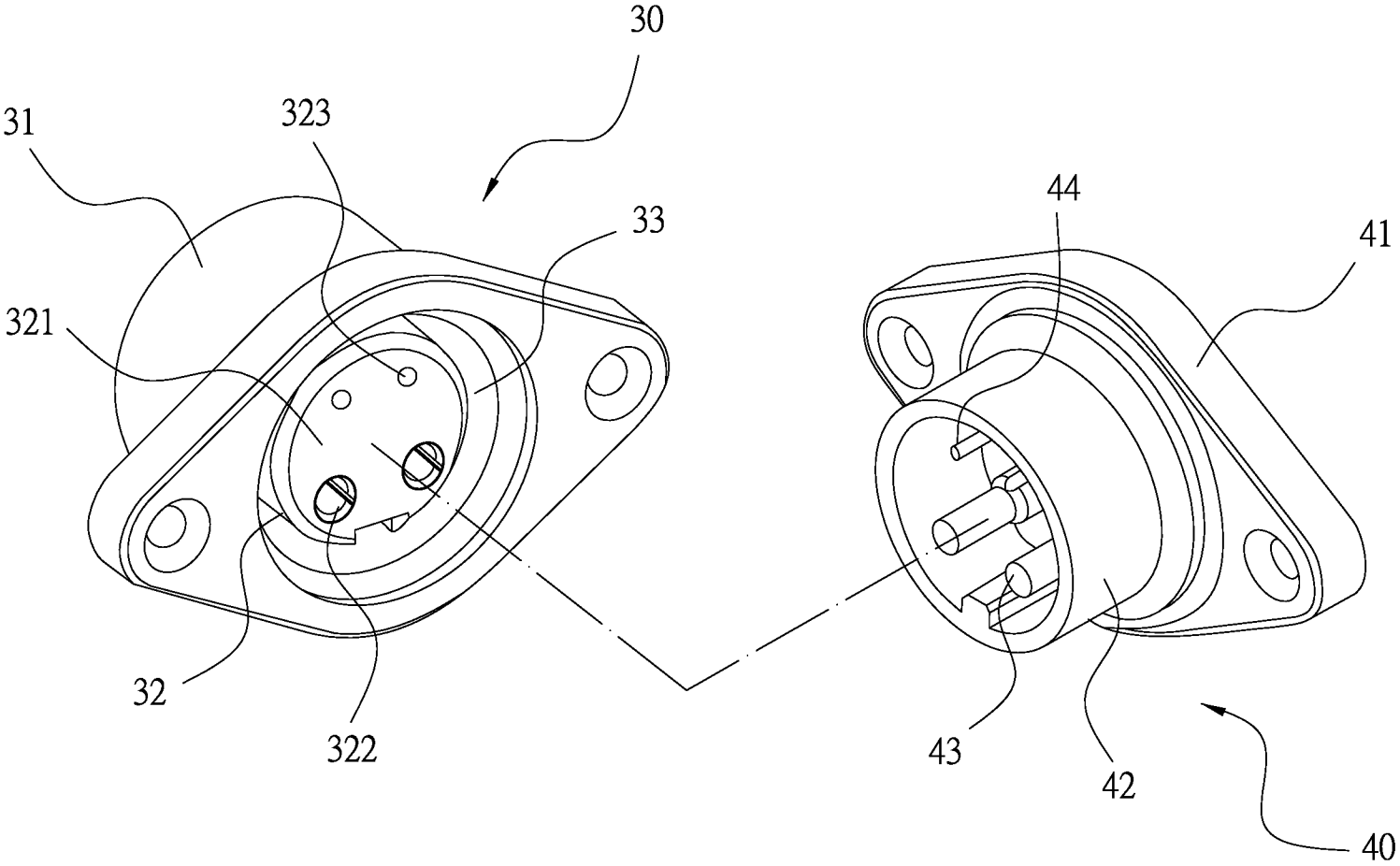
FIG. 11 PRIOR ART
FIG. 11 is a prior art.

Referring to FIGS. 2, 9 and 10, the outer ring portion (17) of the first connecting member (10) has a plurality of drains (172) which are communicated with a bottom portion of the peripheral groove (171), and a plurality of drainage channels (211) penetrate through the base (21) of the second connecting member (20), and the drains (172) and the drainage channels (211) are adapted to achieve drainage function. Moreover, at least a first vent (223) penetrates through the inner ring portion (22). When the first connecting member (10) and the second connecting member (20) are connected, the drains (172), the drainage channels (211), and the first vent (223) are communicated to achieve heat discharging function such that through heat convection, the heat generated from the conducting is configured to be discharged from the drainage channels (211) or the drains (172). Moreover, a surface of the base (21) having the protruded first blades (23) and the protruded second blade (24) comprises a vent groove (212) thereon, and the vent groove (212) is communicated with the drainage channels (211), the drains (172), and the first vent (223), the first receiving slots (13), and the second receiving slot (14), so that the heat discharging function is extended to the first receiving slots (13) and the second receiving slot (14), and the conductive terminal (16), the first blades (23), and the second blade (24) are adapted to contact with air to achieve the heat discharging directly.

Referring to FIG. 9, the first connecting member (10) comprises an accommodating periphery (173) located at an end thereof other than the outer ring portion (17), and the first pin (163) of the conductive terminal (16) is surrounded by the accommodating periphery (173), and a hot melt adhesive (HMA) layer (18) filled in the accommodating periphery (173) is configured to form a seal between the first pin (163) and the cover board (113), so as to achieve the waterproof effect and secure the positions of the cover board (113), the conductive terminal (16) and the signal channels (111).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An electrical connector comprising a first connecting member and a second connecting member;

wherein the first connecting member is defined by an x-y-z axis system, which are perpendicular to each other; the first connecting member comprises a cylindrical socket extended along the z-axis, and a connecting surface is formed at an end of the socket perpendicular to the z-axis; the connecting surface has two rectangular first receiving slots and a rectangular second receiving slot thereon; each of the two first receiving slots has two long edges which are parallel to the y-axis, and the second receiving slot comprises two long edges which are parallel to the x-axis; an outer surface of the socket comprises at least a guiding groove extended along the z-axis; each of the two first receiving slots has two short edges, and one of the two short edges of the first receiving slot is located adjacent to the guiding groove while the other of the two short edges thereof is located adjacent to one of the two long edges of the second receiving slot; each of the first receiving slot and the second receiving slot comprises at least a conductive terminal installed therein; the socket is surrounded by an outer ring portion, and a peripheral groove is formed between the socket and the outer ring portion; and wherein the second connecting member has a base and an inner ring portion which are formed integrally, and the base has two first blades and a second blade which are formed in board body and respectively protrude from the base at positions corresponding to the first receiving slots and the second receiving slot; the first blades and the second blade are surrounded by the inner ring portion, and an inner periphery of the inner ring portion has at least a protruded guiding piece adjacent to the two first blades, and an O-ring is disposed on an outer periphery of the inner ring portion; the inner ring portion of the second connecting member is adapted to be diagonally inserted into the peripheral groove; when the second connecting member is connected to the first connecting member in diagonal direction, the guiding piece is configured to be coupled with the guiding groove, and the two first blades are guided and coupled with the conductive terminals in the first receiving slots, and thereafter the second blade is guided and coupled with the conductive terminal in the second receiving slot, and the O-ring is abutted against the outer ring portion so as to complete the connection between the first connecting member and the second connecting member.

2. The electrical connector of claim 1, wherein two short edges of the second receiving slot are located at two lateral sides of the second receiving slot, and a plurality of signal channels are formed on the socket at two lateral sides of the first receiving slots and the second receiving slot, and the base comprises a plurality of protruded signal pins located at positions corresponding to the signal channels; the length of the signal pin protruding from the base is one half of the length of the second blade; the signal pins are inserted into the signal channels after the second blade is coupled with the conductive terminal.

3. The electrical connector of claim 1, wherein an end of the inner ring portion away from the base comprises an oblique opening, and with the oblique opening, the height of the inner ring portion adjacent to the guiding piece is lower than that of the inner ring portion adjacent to the second blade, and the oblique opening is adapted to guide the second connecting member to be diagonally inserted into the first connecting member.

4. The electrical connector of claim 1, wherein the outer ring portion of the first connecting member has a plurality of drains which are communicated with a bottom portion of the peripheral groove, and a plurality of drainage channels penetrate through the base of the second connecting member, and the drains and the drainage channels are adapted to achieve drainage function.

5. The electrical connector of claim 4, wherein at least a first vent penetrates through the inner ring portion; when the first connecting member and the second connecting member are connected, the drains, the drainage channels, and the first vent are communicated to achieve heat discharging function.

6. The electrical connector of claim 5, wherein a surface of the base having the protruded first blades and the protruded second blade comprises a vent groove thereon, and the vent groove is communicated with the drainage channels, the drains, and the first vent, the first receiving slots, and the second receiving slot, so that the heat discharging function is extended to the first receiving slots and the second receiving slot.

7. The electrical connector of claim 1, wherein the conductive terminal comprises a positioning piece, an elastic piece, and a first pin, and the positioning piece is adapted to be inserted and secured in the first receiving slot or the second receiving slot; an end of the positioning piece adjacent to the connecting surface has a folded portion, and an end of the elastic piece is connected to the folded portion while the other end thereof is suspended and located in the first receiving slot or the second receiving slot; the first pin is configured to protrude from an end of the positioning piece other than the folded portion.

8. The electrical connector of claim 7, wherein each of the first receiving slot and the second receiving slot comprises two conductive terminals inserted therein, and the first blade or the second blade is coupled and held between the two elastic pieces of the two conductive terminals.

9. The electrical connector of claim 7, wherein a surface of the socket other than the connecting surface comprises a recess thereon, and the recess is communicated with the first receiving slots and the second receiving slot; a cover board is coupled in the recess, and the first pin of the conductive terminal penetrates through and protrudes from the cover board.

10. The electrical connector of claim 9, wherein the first connecting member comprises an accommodating periphery located at an end of the first connecting member other than the outer ring portion, and the first pin of the conductive terminal is surrounded by the accommodating periphery, and a hot melt adhesive (HMA) layer filled in the accommodating periphery is configured to form a seal between the first pin and the cover board.

* * * * *